United States Patent [19]

Faber

[11] Patent Number: 4,697,513

[45] Date of Patent: Oct. 6, 1987

[54] BELT STAMP

[75] Inventor: Ernst Faber, Wels, Austria

[73] Assignee: Walter Just Gesellschaft m.b.H, Wels, Austria

[21] Appl. No.: 821,959

[22] Filed: Jan. 24, 1986

[30] Foreign Application Priority Data

Feb. 5, 1985 [AT] Austria ..... 322/85

[51] Int. Cl.[4] ..... B41J 1/20; B41K 1/10

[52] U.S. Cl. ..... 101/111; 101/405

[58] Field of Search ..... 101/105, 111, 405, 406, 101/371, 372, 368, 373

[56] References Cited

U.S. PATENT DOCUMENTS

| | | | |
|---|---|---|---|
| 988,242 | 3/1911 | Blitz | 101/110 |
| 1,401,436 | 12/1921 | Pannier | 101/105 |
| 1,687,951 | 10/1928 | Putnam et al. | 101/368 |
| 2,088,009 | 7/1937 | Melind | 101/111 |
| 2,273,816 | 2/1942 | Boekeloo | 101/111 X |

*Primary Examiner*—Charles A. Pearson
*Attorney, Agent, or Firm*—Kurt Kelman

[57] ABSTRACT

A belt stamp comprises a housing (1), and a baseplate (11), which is hinged to a bottom end of the housing and is adapted to be swung open from a closed position and carries a printing plate (12). A stamping belt assembly (5) is mounted in the housing (1) and is adjustable therein by screws in a direction which is normal to the baseplate (11). The stamping belt assembly comprises stamping belts (9), which carry type (10), which is adapted to extend through a window (13) formed in the baseplate. In order to facilitate the assembling of the stamp and to simplify the replacement of the baseplate (11), the baseplate carries at its top a hinge pin (15), which is parallel to the baseplate and is pivoted in an inwardly open half-bushing (14), which is carried by the housing (1). Owing to that arrangement the hinge pin (15) can leave the half-bushing (14) when the baseplate (11) has been swung open and the baseplate (11) can then be removed from the housing.

6 Claims, 3 Drawing Figures

BELT STAMP

BACKGROUND OF THE INVENTION

1. Field of the Invention

This invention relates to a belt stamp comprising a housing, a baseplate carrying a printing plate and hinged to the bottom end of the housing to be pivoted from a closed into an open position, and a stamping belt assembly adjustable in the housing by set screw means in a direction which is normal to the baseplate in the closed position. The stamping belt assembly comprises stamping belts which carry type adapted to act through a window formed in the baseplate.

2. Description of the Prior Art

In belt stamps of the kind described above, the baseplate is resiliently or rigidly locked in a closed position but must be swung open so that the several stamping belts can be adjusted, in most cases for printing a given date. In other known belt stamps comprising a baseplate, the belts can be adjusted or displaced without turning the baseplate to an open position. But in such stamps the window which is formed in the baseplate and through which the type provided on the stamping belts extends must be relatively wide in order to ensure that the type on the stamping belts will not strike against the longitudinal edges of the window and the latter will not obstruct the desired adjustment or shifting of the belts. On the other hand, the provision of a wide window in the baseplate will obviously reduce the area which is available for printing dies on the printing plate which is carried by the baseplate. In such stamps, the permanent imprint produced by the printing dies on the printing plate is to be combined with a changing imprint, consisting particularly of dates, produced by the stamping belts.

If a uniform imprint is to be produced by the stamp, the type on the stamping belts will have to be moved to a position in the plane of the surface of the printing dies on the printing plate. For this reason the stamping belt assembly is mounted in the housing for an adjustment by set screw means in a direction which is normal to the plane of the baseplate. In that case, a desired printing plate consisting, as a rule, of rubber, can be glued to the baseplate and the stamping belt assembly can then be adjusted to a position in which the surface of the type on the stamping belts and the surface of the printing dies on the printing plate lie in a common plane.

In dependence on the purpose for which the stamp is intended and on the imprint to be produced by the printing plate, it is necessary to provide baseplates and printing plates of various sizes and configurations. To avoid the making of a separate entire stamp for each imprint having a given configuration or size, it is already known to provide in a primary assembling operation identical housings with baseplates differing in area and/or configuration as may be required. But that practice involves a relatively high expenditure of labor because a subsequent replacement of the baseplate is hardly possible or at least very difficult.

SUMMARY OF THE INVENTION

For this reason, it is an object of the invention so to improve the belt stamp described first hereinbefore that different baseplates can quickly be assembled or the baseplate can easily be replaced without a change of the remaining components of the stamp and that this is accomplished in a stamp which is simple in structure so that it can be manufactured at low cost.

This object is accomplished in accordance with the invention with baseplate carrying at its top a hinge pin which is parallel to the baseplate and is pivoted in an inwardly open half-bushing carried by the housing.

For the purposes of the present invention, the term "half-bushing" includes also bushings for contacting the periphery of the hinge pin through slightly less than 180 degrees, provided that the hinge pin is held by the half-bushing against a backlash in a direction that is normal to the plane of the baseplate when the latter is in its closed position.

The hinge which is required to permit the baseplate to be swung open is so designed that the baseplate can readily be separated from the housing, provided that the baseplate has been swung open at least to some extent because the half-bushing is closed on the underside so that the hinge pin cannot be pulled off in a downward direction when the baseplate is in its closed position. Just as easily as the baseplate which has been swung open can be detached from the housing, another baseplate or a baseplate having a different shape or size can be connected to the housing by inserting the hinge pint into the half-bushing if that baseplate carries a hinge pin which is arranged in the same manner.

The baseplate is changed either only during the primary assembling operation or, in rare cases, when a printing plate having a different size or configuration is required. On the other hand, if the stamping belt assembly serves for date stamping, the baseplate must be swung open daily or almost daily for an adjustment of the belts to the proper date. In order to ensure that the baseplate will not unintendedly separate from the housing whenever it is swung open, the stamping belt assembly covers the opening of the half-bushing at least in part when the assembly is in its operating position. When the baseplate is to be changed, it will be sufficient to displace the stamping belt assembly upwardly, away from the baseplate, so that the opening of the half-bushing will be exposed. This displacement can be effected without difficulty because the stamping belt assembly is mounted in the housing for adjustment by set screw means in a direction which is normal to the baseplate.

A particularly simple and suitable design can be achieved by providing a U-shaped yoke which supplements and is screw-connected to the housing. The embraces the stamping belt assembly and is formed with the half-bushing at the free end of one of its legs while the free end of the other leg has a detent recess for receiving a retaining bar carried by the baseplate and a cam face below the recess for guiding the retaining bar to the recess. As the baseplate is swung back to its closed position, the retaining bar strikes the cam face so that the adjacent leg of the yoke is slightly forced outwardly with elastic deformation until the bar snaps into the detent recess to lock the baseplate in position. To ensure an adequate strength, the U-shaped yoke is preferably made of metal whereas the housing may be made of thin plastic.

To enables the baseplate to be easily unlocked and swung open from its operating position, the baseplate is provided adjacent to the retaining bar with a fingerpiece, which protrudes outwardly from the housing.

The baseplate may consist of plastic and may be provided with a metal frame, which lines the window in the baseplate and has a top portion protruding over the window, and the frame carries brackets which, on one side of the frame, carry the hinge pin and, on the other side, carry the retaining bar and the fingerpiece. Owing to such an arrangement, identical frames can be used for baseplates which differ in size and configuration so that the manufacture can be further simplified.

If the stamping belt assembly comprises a plurality of pulleys, which are mounted on a common axle and are rotatable independently of each other and are provided each with a finger disc, and a stamping belt is trained around each of the pulleys, it is possible in accordance with the invention so to arrange the axle for the pulleys that its axis is offset to one side of the center plane of the housing and/or yoke to which the axis of that axle is parallel, and that the finger discs protrude on one side through slots formed in the housing wall. Belt pulleys and finger discs have previously been provided only in stamps in which the baseplate cannot be swung open. Known stamps having a baseplate which can be swung open are not provided with finger discs and in such stamps the belts are adjusted by means of a little rod inserted between the type on the belts when the baseplate has been swung open. It will be understood that the adjustment by means of the small rod is more complicated than the actuation of the finger discs with the fingers. For this reason, the invention provides finger discs which protrude from the slots on one side of the stamp so that there is no need for a little rod for adjusting the stamping belts.

DETAILED DESCRIPTION OF THE PREFERRED EMBODIMENT

Figure 1:
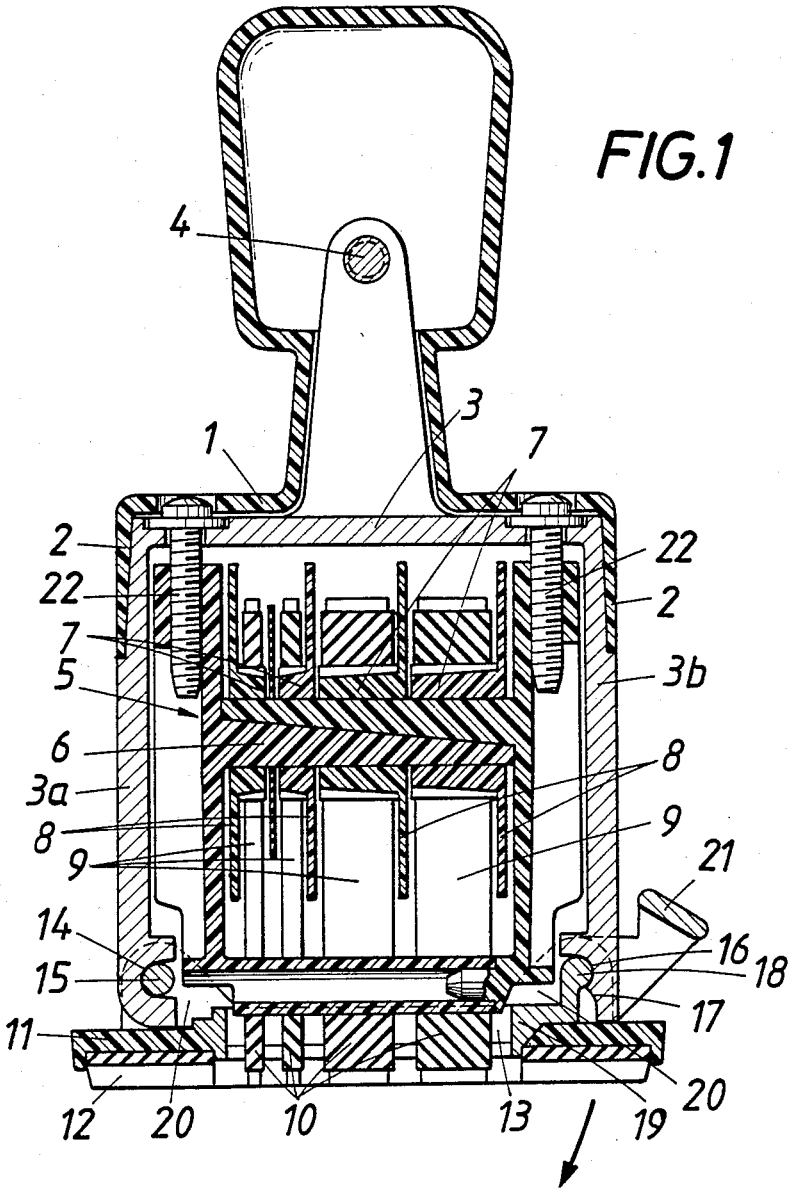
FIG. 1 is a longitudinal sectional view taken on line I—I in FIG. 2 and showing a belt stamp.

A stamp housing 1 has fixedly connected to it by a fastening screw 4 a U-shaped yoke 3, which supplements the end walls 2 of the housing. The U-shaped yoke embraces a stamping belt assembly 5 comprises a plurality of pulleys 7, each of which is non-rotatably connected to a radially protruding finger disc 8 and which are mounted on a common axle 6 and rotatable independently of each other. A stamping belt 9, which carries type elements 10, is trained around each of the pulleys 7.

Figure 3:
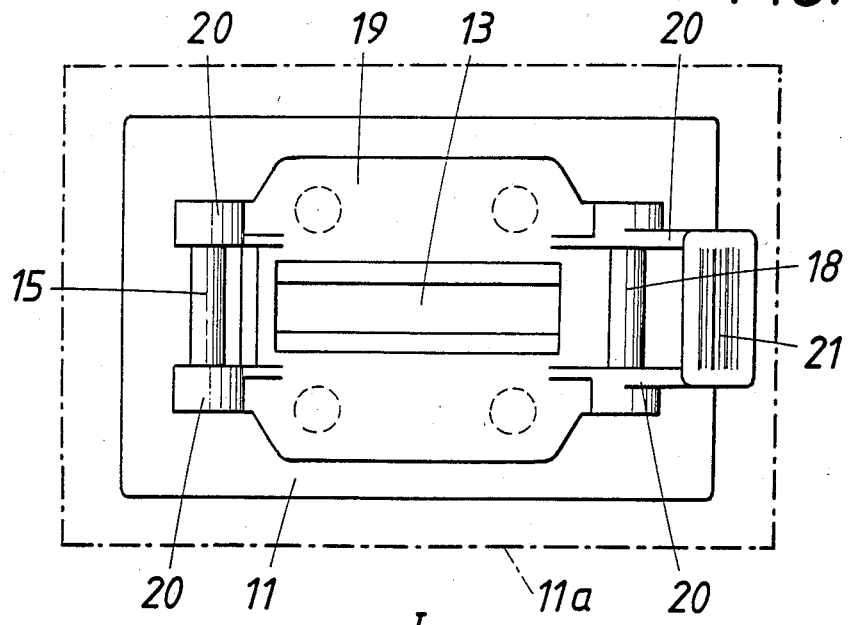
FIG. 3 is a plan view showing only the baseplate and the frame secured thereto.

The housing 1 is provided with a baseplate 11, to which a printing plate 12 has been adhesively joined. The baseplate 11 and the printing plate 12 are formed with a window 13, through which the type elements 10 on the stamping belts 9 can extend in order to be effective. To permit an adjustment of the stamping belts 9 by means of the finger discs 8 and the pulleys 7, the baseplate 11 must be swung open. One leg **3*a* of the U-shaped housing yoke 3 is formed on the inside of its free end with an inwardly open half-bushing 14 pivotally receiving a hinge pin 15 which is carried by, and extends parallel to, the baseplate. The other leg 3*b* of the U-shaped housing yoke 3 is formed at its free end on the inside with a detent recess 16 for receiving a retaining bar 18 carried by the baseplate and is provided below the recess 16 with a cam face for guiding the retaining bar 18 to the recess 16. The window 13 in the baseplate is lined by a metal frame 19 which has top portions protruding inwardly over the window 13 (FIG. 3). The frame 19 carries brackets 20 for the hinge pin 15 on one side and the retaining bar 18 on the other side of the frame. Adjacent to the retaining bar 18 the brackets 20 carry also a fingerpiece 21, which protrudes outwardly from the housing 1. It will be understood that the frame 19 is permanently joined to the baseplate 11**.

When the fingerpiece 21 is depressed, the leg **3*b* of the housing yoke will be elastically deflected outwardly and the retaining bar 18 will leave the detent recess 16 so that the entire baseplate 11 together with the printing plate 12 can be swung open about the hinge pin 15. It is apparent from FIG. 1 that the stamping belt assembly 5 can be adjusted relative to the housing yoke 3 and to the housing 1 by means of set screws 22 in a direction which is normal to the baseplate. It is also apparent from FIG. 1 that the stamping belt assembly 5 partly covers the open side of the half-bushing 14 so as to prevent the hinge pin 15 from leaving the half-bushing 14. When the stamping belt assembly 5 has been raised by means of set screws 22 so as to expose the open side of the half-bushings and the baseplate 11 has been swung open, it will be possible to move the hinge pin 15 out of the half-bushing 14. Now the baseplate 11 can be removed and can be replaced by a different baseplate 11*a*, which is indicated in phantom in FIG. 3**.

The arrangement is such that, by the cooperation of the detent recess 16 and the retaining bar 18 and by the cooperation between the half-bushing 14 and the hinge pin 15, the baseplate 11 is held in its closed position against a backlash in any direction that is normal to the axis of the hinge pin 15 so that the bearing contact between the latter and the half-bushing 14 will be maintained.

Figure 2:
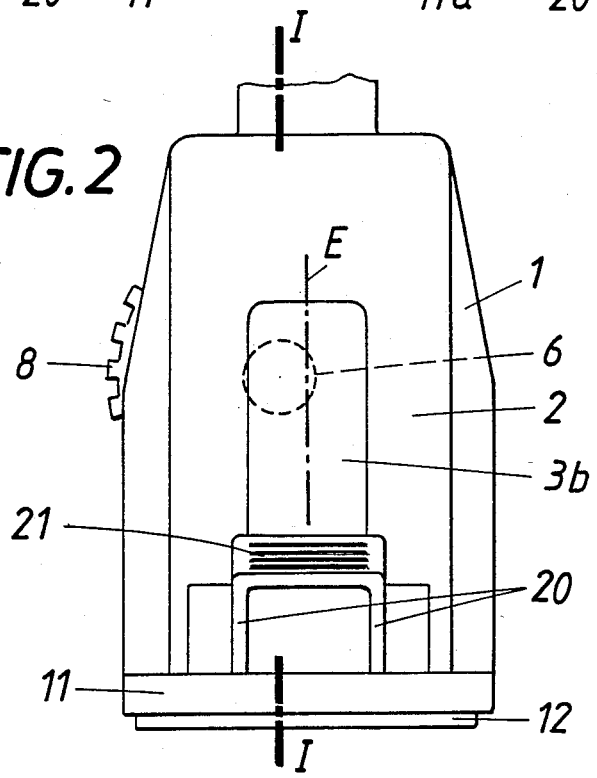
FIG. 2 is an associated side elevation.

It is apparent from FIG. 2 that the axis of the axle 6 for the pulleys 7 is parallel to the center plane E of the housing and yoke and is laterally offset from this plane so that the finger discs 8 protrude on one side through slots in a wall of the housing 1 and can be actuated on that side.

I claim:

1. In a belt stamp comprising a housing having an open bottom end;

a baseplate defining a window and adapted to be held in a position closing the open bottom end of the housing;

hinge means connecting the baseplate to the bottom end of the housing and permitting the baseplate to be pivoted from the closing position into an open position;

a stamping belt assembly comprising a plurality of adjacent stamping belts each carrying type adapted to extend in an operating position through the window in the baseplate in the closing position thereof, the stamping belt assembly being mounted in the housing for adjustment relative thereto in a direction normal to the base plate in the closing position thereof, and set screw means for adjusting the stamping belt assembly relative to the housing in the normal direction to assume the operating position, the improvement which comprises a half-bushing having an inwardly facing opening, the half-bushing being carried by the bottom end of the housing and having an axis extending parallel to the base plate in the closing position thereof, a hinge pin carried by the baseplate and disposed thereabove and parallel thereto, the hinge pin being pivoted in the half-bushing about the axis thereof, the half-bushing and hinge pin constituting the hinge means and the stamping belt assembly at least partly covering the inwardly facing opening when the baseplate is in the closing position to retain the hinge pin in the half-bushing in the operating position of the stamping belt assembly.

2. The improvement set forth in claim 1, wherein the housing carries a U-shaped housing yoke having a first leg and a second leg depending from the housing on opposite sides of the stamping belt assembly, the legs having free end portions constituting the open bottom end of the housing, the free end portion of the first leg being formed with the half-bushing and the free end portion of the second leg defining a detent recess and a cam face rising to the detent recess, and wherein the baseplate carries a retaining bar arranged to move along the cam face into the detent recess as the baseplate is pivoted from the open into the closing position about the hinge means.

3. The improvement set forth in claim 2, wherein said baseplate carries adjacent to said retaining bar a fingerpiece, which laterally protrudes from said housing when said baseplate is in said closing position.

4. The improvement set forth in claim 2, further comprising fastening screw means which connect said yoke to said housing.

5. The improvement set forth in claim 2, wherein the baseplate consists of plastic, and further comprising a metal frame lining the window of the baseplate and having top portions protruding inwardly over the window, first and second brackets carried by the metal frame on opposite sides thereof, the first brackets carrying the hinge pin, and the second brackets carrying the retaining bar.

6. The improvement set forth in claim 5, wherein said second brackets carry a fingerpiece, which protrudes out of the housing when said baseplate is in said closing position.

* * * * *